US008196564B2

(12) United States Patent
Borchsenius et al.

(10) Patent No.: US 8,196,564 B2
(45) Date of Patent: Jun. 12, 2012

(54) METHOD FOR DETERMINING A CONTROLLED VARIABLE FOR PRESSURE CONTROL OF A HIGH-PRESSURE ACCUMULATOR IN AN INJECTION SYSTEM

(75) Inventors: Fredrik Borchsenius, Donaustauf (DE); Michael Wirkowski, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 512 days.

(21) Appl. No.: 12/524,763

(22) PCT Filed: Jan. 28, 2008

(86) PCT No.: PCT/EP2008/050976

§ 371 (c)(1),
(2), (4) Date: Jul. 28, 2009

(87) PCT Pub. No.: WO2008/095815

PCT Pub. Date: Aug. 14, 2008

(65) Prior Publication Data

US 2010/0132668 A1 Jun. 3, 2010

(30) Foreign Application Priority Data

Feb. 5, 2007 (DE) ..... 10 2007 005 685

(51) Int. Cl.
*F02M 63/04* (2006.01)

(52) U.S. Cl. ..... 123/447; 73/114.43; 73/114.41; 73/114.42

(58) Field of Classification Search ..... 123/447; 73/114.43, 114.41, 114.42
See application file for complete search history.

(56) References Cited

U.S. PATENT DOCUMENTS

| | | | | |
|---|---|---|---|---|
| 6,840,233 | B2 * | 1/2005 | Lingenhult et al. | 123/519 |
| 7,278,405 | B2 * | 10/2007 | Takahashi | 123/514 |
| 2008/0264155 | A1 * | 10/2008 | Achleitner et al. | 73/114.42 |
| 2010/0132668 | A1 * | 6/2010 | Borchsenius et al. | 123/447 |

FOREIGN PATENT DOCUMENTS

| | | | |
|---|---|---|---|
| DE | 10160311 | A1 | 6/2003 |
| DE | 102007000212 | A1 | 10/2007 |
| DE | 19731201 | A1 | 1/2009 |
| EP | 0860601 | A2 | 8/1998 |
| JP | 11148412 | A | 6/1999 |

OTHER PUBLICATIONS

International Search Report, PCT/EP2008/050976, 10 pages, Sep. 6, 2008.

German Office Action, German application No. 10 2007 005 685.2-13, 3 pages, Sep. 28, 2007.

* cited by examiner

*Primary Examiner* — Erick Solis
(74) *Attorney, Agent, or Firm* — King & Spalding L.L.P.

(57) ABSTRACT

In a method for determining a controlled variable of pressure control of a high-pressure accumulator of an injection system, a setpoint pressure gradient value is determined in the high-pressure accumulator as a function of the maximum possible actual pressure gradient value.

9 Claims, 2 Drawing Sheets

METHOD FOR DETERMINING A CONTROLLED VARIABLE FOR PRESSURE CONTROL OF A HIGH-PRESSURE ACCUMULATOR IN AN INJECTION SYSTEM

CROSS-REFERENCE TO RELATED APPLICATIONS

This application is a U.S. National Stage Application of International Application No. PCT/EP2008/050976 filed Jan. 28, 2008, which designates the United States of America, and claims priority to German Application No. 10 2007 005 685.2 filed Feb. 5, 2007, the contents of which are hereby incorporated by reference in their entirety.

TECHNICAL FIELD

The invention relates to a method for determining a controlled variable for pressure control of a high-pressure accumulator in an injection system.

BACKGROUND

Fuel injection apparatuses for operating an internal combustion engine have generally been known for many years. With a so-called common rail injection system, fuel is fed into the respective combustion chamber of the internal combustion engine by means of injectors, in particular by means of piezoinjectors. The quality of the combustion is dependent here upon the high-pressure accumulator. The pressure in the high-pressure accumulator must be controlled in order to achieve as high a specific output of the internal combustion engine as possible and at the same time minimal pollutant emissions. In this way, when a high-pressure pump and a pressure accumulator are used for the fuel, injection pressures of 1600 to 1800 bar can be reached.

The pressure in the high-pressure accumulator can be controlled here in different ways. This can take place depending on the design of the injection system using a pressure control valve in the high-pressure region and a volume control valve on the low pressure side of the high pressure pump, or only by means of a volume control valve on the low pressure side of the high pressure pump. The second example, in other words the pressure control with the aid of a volume control valve, is exclusively detailed below. The high pressure accumulator pressure is controlled here by controlling the volume flow in the low pressure region of the high pressure pump. This volume flow control is dependent both on the system requirements, which are determined by the quantity of fuel injected into the combustion chamber, as well as on the fuel quantity which leaves the injectors through the switch leakage losses.

The pressure in the high-pressure accumulator is determined in this case by the fuel quantity supplied by the pump and the fuel quantity escaping via an injection process into the combustion chamber and/or via switch leakages.

The size of an actual pressure gradient value of the high-pressure accumulator is thus dependent on the fuel quantity difference between the fuel quantity, which is delivered from the pump into the high-pressure accumulator, and the fuel quantity which is injected and/or escapes from the injector through switch leakage losses.

If an actual pressure gradient value is now greater than the actual pressure gradient value which is possible for this operating point in the internal combustion engine, this results in a pressure deviation in the high-pressure accumulator, which cannot be counteracted by the pressure controller. A maximum pressure drop and thus a maximum actual pressure gradient value results for instance if the pump no longer conveys fuel into the high pressure accumulator, but at the same time the maximum possible fuel quantity leaves the injector via switch leakages and/or injections into the combustion chamber. If the required target pressure gradient value is now to be greater than the maximum possible actual pressure gradient value, this results for instance in an erroneous increase in the integral part of a PID controller and the control behavior is thus uncalculable.

SUMMARY

According to various embodiments, the quality of the pressure controller in the high-pressure accumulator can be improved.

According to an embodiment, in a method for determining a controlled variable for pressure control of a high-pressure accumulator in an injection system, in particular in a common rail injection system for an internal combustion engine, comprising a pump for supplying a quantity of fuel into the high-pressure accumulator and a measuring unit for determining a pressure value in the high-pressure accumulator, the following step can be performed: determining a target pressure gradient value from a stored engine characteristics map as a function of the determined pressure value in the high pressure accumulator and a differential pressure between the fuel quantity which leaves the injector as a result of a switch leakage and/or injections in the internal combustion engine, and the fuel quantity which is delivered to the high-pressure accumulator by means of the pump.

According to another embodiment, in method for determining a controlled variable for pressure control in a high-pressure accumulator in an injection system, in particular a common rail injection system for an internal combustion engine, comprising a pump for supplying a fuel quantity into the high pressure accumulator and a measuring unit for determining a pressure value in the high-pressure accumulator, the following step can be performed: determining a target pressure gradient value by multiplying a factor with a differential value between the fuel quantity, which leaves the injector as a result of switch leakages and/or injections into the internal combustion engine and the fuel quantity, which is supplied to the high-pressure accumulator through the pump.

According to a further embodiment, the factor can be calculated by dividing an elasticity module of the high-pressure accumulator which is dependent on the high pressure accumulator and the high pressure accumulator temperature and of a hydraulic volume of the overall high pressure range of the injection system.

BRIEF DESCRIPTION OF THE DRAWINGS

Details of the invention are described in more detail with reference to the drawings, in which.

DETAILED DESCRIPTION

Figure 1:
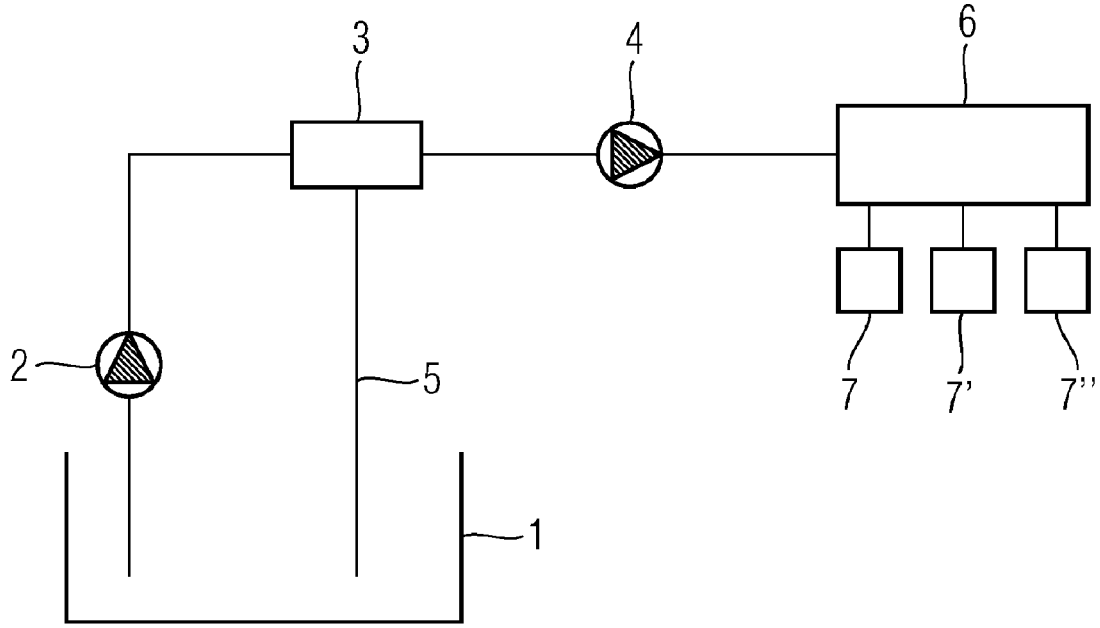
FIG. 1 shows a block diagram of an injection system for controlling the quantity of fuel to be injected.

The advantages achieved with the various embodiments consist in particular in the degree of the target pressure gradient value now being dependent upon the actual pressure gradient value. As a result, a target pressure gradient value which is greater compared with the actual target pressure gradient value is prevented and the control quality is thus improved. FIG. 1 shows a block diagram of an injection system for controlling the fuel injection quantity. Here the injection system consists of a fuel tank 1, a low-pressure pump 2, which delivers fuel from the tank, a volume control valve 3 with a return line 5 to the fuel tank 1, a high-pressure pump 4, which supplies fuel to a high-pressure accumulator 6 and of injectors 7, 7' and 7" for injecting fuel into a combustion chamber of the internal combustion engine, which is not shown in the drawing.

A low-pressure pump 2 delivers fuel from the fuel tank 1 and supplies it to a high-pressure pump 4. The high-pressure pump 4 then delivers the fuel supplied from the low-pressure pump 2 to a high-pressure accumulator 6. Pressures of up to 1800 bar could develop here in the high-pressure accumulator 6. The fuel from the high-pressure accumulator 6 can be injected into a combustion chamber by way of injectors 7, 7' and 7". In order to be able to control the pressure within the high-pressure accumulator 6, a volume control valve 3 with a return line 5 to the fuel tank is arranged between the low-pressure pump 2 and the high-pressure pump 4. The intake volume of the high-pressure pump 2 is controlled with the aid of the volume control valve 3 and thus determines the pressure in the high-pressure accumulator 6.

Figure 2:
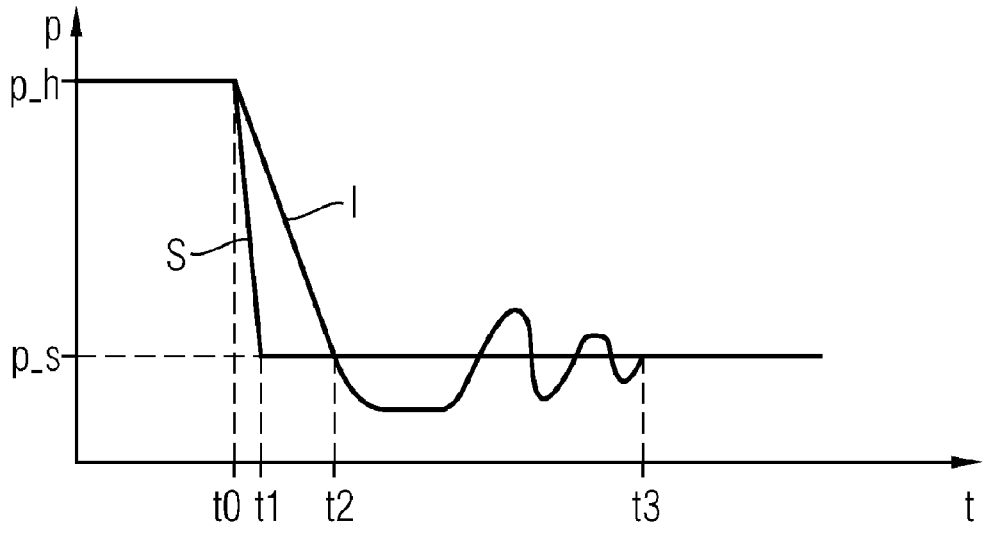
FIG. 2 shows a pressure curve in the high pressure accumulator, in which the target pressure curve is independent of the actual pressure curve.

FIG. 2 shows a pressure curve in the high-pressure accumulator, in which the target pressure curve is independent of the actual pressure curve. The temporal pressure curve p in the high pressure accumulator is plotted here for a target pressure S and an actual pressure I.

A constant pressure p_h prevails in the high-pressure accumulator up until time instant t0. The pressure in the high-pressure accumulator, corresponding to the target pressure curve S, is to drop in a linear fashion within the period of time t0 and t1 from the pressure value p_h to a pressure value p_s for instance. The target pressure gradient value is in this way constant within the period of time t0 and t1 and is independent of the actual pressure gradient value. The actual pressure curve I likewise drops from time instant t0, like the target pressure S, almost linearly and reaches the pressure value p_s at the time instant t2.

As the target pressure gradient curve is in this case independent of the actual pressure gradient curve, and the target pressure gradient value, as a result of the more significant drop in the target pressure curve S, compared with the actual pressure curve, is greater than the maximum actual pressure gradient value, the control behavior within the injection system is incalculable. This is particularly apparent in that the pressure in the high pressure accumulator drops below the target pressure p_s after the time instant t2 and fluctuates repeatedly around the target pressure p_s up until time instant t3. Fluctuations in the actual pressure I only no longer take place after the time instant t3 and it is only then that the desired target pressure p_s is set.

Figure 3:
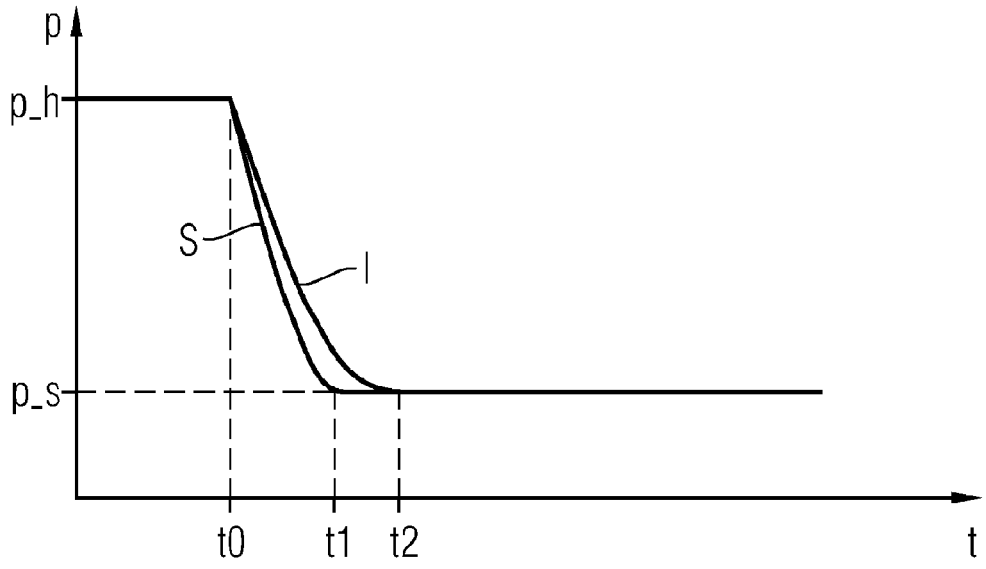
FIG. 3 shows a pressure curve in the high pressure accumulator, in which the target pressure curve is dependent on the actual pressure curve.

FIG. 3 shows a pressure curve in the high-pressure accumulator, in which the actual pressure gradient value is dependent on the target pressure gradient value. The temporal pressure curve p in the high-pressure accumulator is plotted in this way for a target pressure S and an actual pressure I.

From time instant t0, the target pressure curve drops from pressure p_h until time instant t1 to the pressure p_s. The drop in target pressure is in this case not linear nor dependent on the actual pressure gradient value.

In a first embodiment, the target pressure gradient value is taken from a stored engine characteristics map. The target pressure gradient value is determined in this case from the engine characteristics map as a function of the actual pressure in the high pressure accumulator and of the differential value, the fuel quantity which is fed to the high pressure accumulator by the pump and the fuel quantity which escapes into the combustion chamber as a result of the switch leakages and injections.

In a second embodiment for determining the target pressure gradient value, provision is made for the differential value between the fuel quantity, which is supplied to the high-pressure accumulator by the pump, and the fuel quantity, which enters the combustion chamber as a result of switch leakages and injections to be multiplied by a factor. This factor is formed from a division of an elasticity module value of the high-pressure accumulator and an overall hydraulic volume of the high-pressure range. The elasticity module value is stored here in an engine characteristics map for instance and is dependent on the temperature and the actual pressure in the high pressure accumulator.

The actual pressure curve I shows that the pressure p_h likewise drops from time instant t0 and reaches the target pressure value p_s at time instant t2. Since the target pressure gradient value now depends on the actual pressure gradient value, and thus the target pressure gradient value is at no point greater than the actual pressure gradient value, after time instant t2 this does not result in the target pressure p_s not be reached or being exceeded as a result of the actual pressure curve I.

What is claimed is:

1. A method for determining a controlled variable for pressure control of a high-pressure accumulator in an injection system comprising a pump for supplying a quantity of fuel into the high-pressure accumulator and a measuring unit for determining a pressure value in the high-pressure accumulator, the method comprising the steps of:

determining a target pressure gradient value from a stored engine characteristics map as a function of the determined pressure value in the high pressure accumulator and a differential pressure between the fuel quantity which leaves the injector as a result of at least one of a switch leakage and injections in the internal combustion engine, and the fuel quantity which is delivered to the high-pressure accumulator by means of the pump.

2. A method for determining a controlled variable for pressure control in a high-pressure accumulator in an injection system comprising a pump for supplying a fuel quantity into the high pressure accumulator and a measuring unit for determining a pressure value in the high-pressure accumulator, the method comprising the steps of:

determining a target pressure gradient value by multiplying a factor with a differential value between the fuel quantity, which leaves the injector as a result of at least one of switch leakages and injections into the internal combustion engine and the fuel quantity, which is supplied to the high-pressure accumulator through the pump.

3. The method according to claim 2, wherein the factor is calculated by dividing an elasticity module of the high-pressure accumulator which is dependent on the high pressure accumulator and the high pressure accumulator temperature and of a hydraulic volume of the overall high pressure range of the injection system.

4. The method according to claim 1, wherein the injection system is a common rail injection system for an internal combustion engine.

5. The method according to claim 2, wherein the injection system is a common rail injection system for an internal combustion engine.

6. A system for determining a controlled variable for pressure control of a high-pressure accumulator in an injection system, comprising a pump for supplying a quantity of fuel into the high-pressure accumulator and a measuring unit for determining a pressure value in the high-pressure accumulator, the system being operable to determine a target pressure gradient value from a stored engine characteristics map as a function of the determined pressure value in the high pressure accumulator and a differential pressure between the fuel quantity which leaves the injector as a result of at least one of a switch leakage and injections in the internal combustion engine, and the fuel quantity which is delivered to the high-pressure accumulator by means of the pump.

7. The system according to claim 6, wherein the injection system is a common rail injection system for an internal combustion engine.

8. The system according to claim 6, comprising a fuel tank coupled with a low-pressure pump, a volume control valve with a return line coupled with the fuel tank, and a high-pressure pump which supplies fuel to a high-pressure accumulator and of a plurality of injectors.

9. The system according to claim 8, wherein an intake volume of the high-pressure pump is controlled with the aid of the volume control valve and determines the pressure in the high-pressure accumulator.

* * * * *